US005941158A

United States Patent [19]

Davies et al.

[11] Patent Number: 5,941,158

[45] Date of Patent: Aug. 24, 1999

[54] FLUID PRESSURE ACTUATOR AND ACTUATOR SYSTEM

[75] Inventors: Stephen Harlow Davies, Telford; Alan Terry Rollason, Wolverhampton, both of United Kingdom

[73] Assignee: Lucas Industries, United Kingdom

[21] Appl. No.: 08/960,933

[22] Filed: Oct. 30, 1997

[30] Foreign Application Priority Data

Feb. 11, 1996 [GB] United Kingdom ..... 9622893

[51] Int. Cl.[6] ..... F01B 7/00; F15B 15/22

[52] U.S. Cl. ..... 92/62; 92/65

[58] Field of Search ..... 92/62, 65; 91/535, 91/536

[56] References Cited

U.S. PATENT DOCUMENTS

| | | | |
|---|---|---|---|
| 4,561,248 | 12/1985 | Quin et al. | 60/413 |
| 4,638,718 | 1/1987 | Nakamura | 92/62 |
| 4,773,300 | 9/1988 | Klatt et al. | 91/169 R |
| 5,165,322 | 11/1992 | Moody | 92/65 |

FOREIGN PATENT DOCUMENTS

| | | | |
|---|---|---|---|
| 830896 | 5/1938 | France . | |
| 3337969 | 5/1985 | Germany . | |
| 708582 | 5/1954 | United Kingdom . | |
| 911709 | 11/1962 | United Kingdom | 92/62 |

*Primary Examiner*—Sheldon J. Richter
*Attorney, Agent, or Firm*—Michael Best & Friedrich LLP

[57] ABSTRACT

A fluid pressure-operated actuator comprises a cylinder body containing a piston slidable therein, the piston defining respective chambers at opposite sides thereof. A rod projects from one side of the piston and extends through an end wall of the cylinder and a plunger is slidable on the rod and also extends through the end wall. The arrangement is such that the application of fluid pressure simultaneously to the chambers results in movement of the piston lengthwise of the rod, the piston movement including a first part during which the plunger applies force to the rod in addition to that arising on the piston, and a second part during which the force from the plunger is absent.

14 Claims, 1 Drawing Sheet

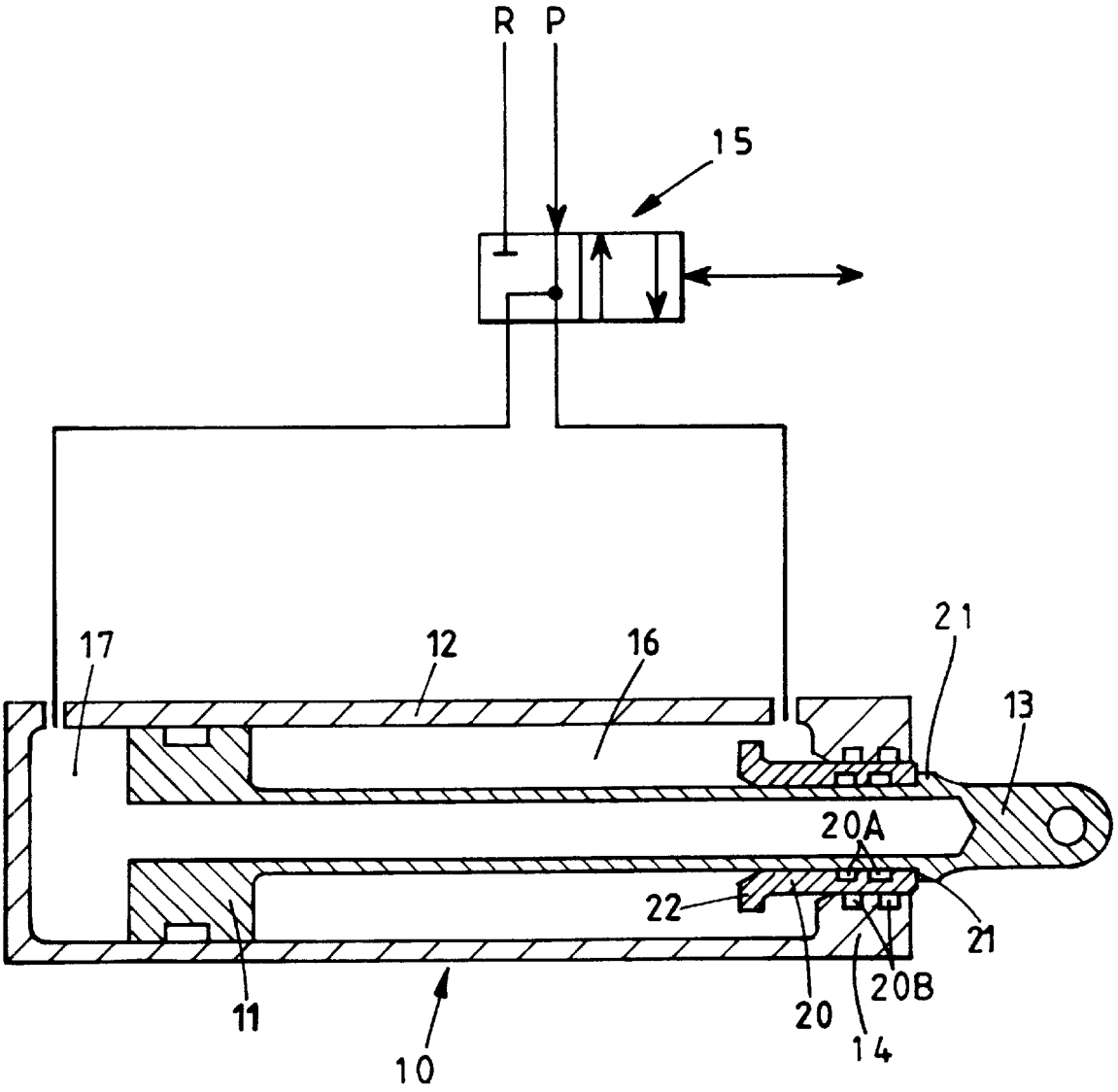
R
P
15
17
12
16
21
13
20A
22
21
20B
11
20
14
10

FLUID PRESSURE ACTUATOR AND ACTUATOR SYSTEM

This invention relates to a fluid pressure-operated actuator having a piston movable in a cylinder under the action of pressure fluid introduced into the cylinder, the piston actuating a working device by way of a piston rod extending through an end wall of the cylinder. The invention also embraces an actuator system incorporating such an actuator.

The use of such an actuator to move an initially stationary working device can require a high initial force to initiate the movement. Where an actuator system is constrained by an upper limiting value of available fluid pressure, it is commonly the practice to increase the effective piston areas of the actuator in order to provide the necessary initial force. Such a solution, however, results not only in an increase in the mass of the actuator but, by increasing the volume of fluid required to be displaced at each stroke, increases the mass of a pump which provides the required fluid pressure. In many applications, in particular in aircraft systems, such increases of mass are to be avoided.

It is an object of the invention to provide a fluid pressure-operated actuator of compact dimensions which can impart an increased initial force to a working device, and also to provide an actuator system including the aforesaid actuator.

According to a first aspect of the invention, a fluid pressure-operated actuator comprises a cylinder body containing a piston slidable therein which defines respective chambers at its opposite sides, a rod projecting from one side of the piston and extending through an end wall of the cylinder, a plunger slidable on the rod and extending through the end wall, the arrangement being such that application of fluid pressure simultaneously to the chambers results in movement of the piston in the lengthwise direction of the rod, the piston movement including a first part during which the plunger applies force to the rod in addition to that arising on the piston, and a second part during which the force from the plunger is absent.

In a preferred arrangement, the respective opposite sides of the piston have different effective areas, enabling piston movement to be effected by the application of the same fluid pressure to each piston side.

Preferably, the plunger has an effective area less than the larger piston area and the plunger is conveniently not in sealing engagement with the cylinder internal wall.

Typically, the rod carries an abutment against which the plunger engages during the first part of the piston movement and the plunger conveniently carries abutment means arranged to engage a stop, conveniently formed by a surface of the cylinder body, which defines the extent of the first piston movement part.

From another aspect of the invention, an actuator system comprises a fluid pressure-operated actuator according to the aforesaid first aspect of the invention, and valve means for controlling fluid flow to the cylinder chambers, the valve means being arranged so that in one operative state thereof, it causes fluid to be directed to both of said chambers simultaneously.

In one advantageous arrangement, the valve, when in its first operative state, interconnects the cylinder chambers so that fluid may be transferred between the chambers in a regenerative action.

The opposed sides of the piston may conveniently be of different effective areas.

The invention will now be described, by way of example, with reference to the single accompanying drawing which is a cross-sectional representation of one form of a piston actuator system of the invention.

As shown in the drawing, an actuator designated generally by the reference 10 comprises a piston 11 slidable in a cylinder body 12 and having a rod 13 which extends through an end wall 14 of the cylinder 12. The effective area of the left-hand end of the piston, as viewed in the drawing, is the full cross-sectional area thereof, whilst the effective area of the right-hand end is the smaller area surrounding the piston rod. A supply pressure P and a return low pressure R are connectable to the cylinder 12 by way of a selector valve designated generally by the reference 15. In the illustrated operative position of the valve 15 the supply pressure P is applied to chambers 16, 17 respectively at opposite sides of the piston 11, the effect being to urge the latter rightwards as a result of the aforesaid difference in effective areas of opposite ends of the piston. As the piston moves to the right, fluid is displaced from the chamber 16 to the chamber 17 in a regenerative action, whereby the net flow of pressurised fluid from a source (not shown), such as a pump, is reduced. Leftward movement of the piston 11 is effected by operation of the valve 15 which, in its alternative position, applies the supply pressure P to the chamber 16 only and connects the chamber 17 to the return pressure R. Since the volume of the chamber 16 over one stroke of the piston 11 is substantially less than that of chamber 17, the net fluid flow over one piston cycle remains reduced.

In order to effect a high initial force during rightward movement of the piston 11, the actuator 10, includes a plunger 20 through which the rod 13 is slidable, being sealed against the internal surface of the plunger by a first seal 20A. The plunger 20 is itself slidable within an opening in the end wall 14, being sealed against the internal surface of the opening by a second seal 20B. A shoulder 21 on the rod 13 acts as an abutment for the plunger 20 when the piston 11 is at the leftward extent of its travel, and the plunger 20 has a flange 22 which limits its rightward movement by engagement with an adjacent surface of the cylinder body.

In use, in the operating condition of the valve 15 shown in FIG. 1 the pressure P is applied to both chambers 16, 17, i.e. both to the left-hand end of the piston 11 and also to the plunger 20. Thus, during initial movement of the piston 11 from its fully leftward position, the plunger 20 imparts an additional force to the rod 13 via the shoulder 21 until the flange 22 engages the opposing surface of the wall 14. The force applied to the rod, therefore, during the initial phase of operation is greater than that resulting from the piston 11 acting alone. Following engagement of the flange 22 against the end wall 14, a force less than the initially applied force is applied to the rod from the piston 11 only. When the valve 15 is placed in its alternative condition, the chamber 17 is connected to the low pressure R and the piston is returned to the left by high pressure in the chamber 16. Because of the small effective area of the plunger relative to that of the piston 11, leftward movement of the piston is not prevented by the plunger 20, which returns to its illustrated inward position.

We claim:

1. A fluid pressure-operated actuator comprising a cylinder body containing a piston slidable therein, respective chambers formed at opposite sides of the piston, an end closure wall of the cylinder body partially defining one of said chambers, a rod projecting from one side of the piston and extending through said end closure wall, a plunger slidable on the rod within said one chamber and extending through said end closure wall, the arrangement being such that application of fluid pressure simultaneously to the chambers results in movement of the piston in the lengthwise direction of the rod in one direction, said piston movement including a first part during which the plunger applies force to the rod in addition to that arising on the piston, and a second part during which no force is applied from the plunger to the rod.

2. An actuator according to claim 1, wherein the respective opposite sides of the piston have different effective areas.

3. An actuator according to claim 1, wherein the plunger has an effective area less than the larger piston area.

4. An actuator according to claim 1, wherein the plunger is not in sealing engagement with the cylinder internal wall.

5. An actuator according to claim 1, wherein the rod carries an abutment against which the plunger engages during the first part of the piston movement.

6. An actuator according to claim 1, wherein the plunger is sealingly engaged around the rod and within the cylinder end wall.

7. An actuator according to claim 1, further comprising force transmitting means acting to transmit force from the plunger to the rod during the first part of the piston movement.

8. An actuator according to claim 1, wherein the plunger carries abutment means arranged to engage a stop which defines the extent of the first piston movement part.

9. An actuator according to claim 8, wherein the plunger abutment means is a generally radial flange thereon arranged to engage a surface of the cylinder body forming the stop.

10. An actuator system incorporating an actuator according to claim 1, and valve means for controlling fluid flow to the cylinder chambers, the valve means being arranged so that, in one operative state thereof, it causes fluid to be directed to both of said chambers simultaneously.

11. A system according to claim 10, wherein the valve means, when in its first operative state, interconnects the cylinder chambers so that fluid may be transferred between the chambers in a regenerative action.

12. A system according to claim 10, wherein the valve means is a spool valve which, in one operative position, interconnects the cylinder chambers and, in another operative position, connects the chamber at the larger area side of the piston to a low pressure region.

13. A fluid pressure-operated actuator comprising a cylinder body containing a piston slidable therein which defines respective chambers at its opposite sides, a rod projecting from one side of the piston and extending through an end wall of the cylinder, a plunger slidable on the rod and extending through the end wall, the arrangement being such that application of fluid pressure simultaneously to the chambers results in movement of the piston in the lengthwise direction of the rod, the piston movement including a first part during which the plunger applies force to the rod in addition to that arising on the piston, and a second part during which the force from the plunger is absent, wherein the rod carries an abutment against which the plunger engages during the first part of the piston movement.

14. A fluid pressure-operated actuator comprising a cylinder body containing a piston slidable therein which defines respective chambers at its opposite sides, a rod projecting from one side of the piston and extending through an end wall of the cylinder, a plunger slidable on the rod and extending through the end wall, the arrangement being such that application of fluid pressure simultaneously to the chambers results in movement of the piston in the lengthwise direction of the rod, the piston movement including a first part during which the plunger applies force to the rod in addition to that arising on the piston, and a second part during which the force from the plunger is absent, wherein the plunger is sealingly engaged around the rod and within the cylinder wall.

* * * * *